US008851314B2

(12) United States Patent
Hudson et al.

(10) Patent No.: US 8,851,314 B2
(45) Date of Patent: Oct. 7, 2014

(54) PERSONAL SIZE CONTAINER

(75) Inventors: Clinton M. Hudson, Merrill, IA (US); Wendy J. Tabbert, Le Mars, IA (US)

(73) Assignee: Wells Enterprises, Inc., Le Mars, IA (US)

( * ) Notice: Subject to any disclaimer, the term of this patent is extended or adjusted under 35 U.S.C. 154(b) by 220 days.

(21) Appl. No.: 13/024,753

(22) Filed: Feb. 10, 2011

(65) Prior Publication Data

US 2012/0205375 A1 Aug. 16, 2012

(51) Int. Cl.

| | |
|---|---|
| ***B65D 41/56*** | (2006.01) |
| ***B65D 43/02*** | (2006.01) |
| ***B65D 51/20*** | (2006.01) |
| *B65D 51/24* | (2006.01) |

(52) U.S. Cl.

CPC .... *B65D 43/0212* (2013.01); *B65D 2543/0074* (2013.01); *B65D 2543/00083* (2013.01); *B65D 2543/00657* (2013.01); *B65D 2543/00805* (2013.01); *B65D 2543/00296* (2013.01); *B65D 51/247* (2013.01); *B65D 51/20* (2013.01); *B65D 2543/00685* (2013.01); *B65D 2251/0062* (2013.01); *B65D 2251/0093* (2013.01); *B65D 2543/00527* (2013.01); *B65D 2543/00027* (2013.01); *B65D 2251/0018* (2013.01); *B65D 2543/00537* (2013.01)

USPC ..... 220/212; 206/541; 220/694

(58) Field of Classification Search

USPC ..... 220/212, 735, 694; 206/216, 223, 541; 426/130

See application file for complete search history.

(56) References Cited

U.S. PATENT DOCUMENTS

| | | | |
|---|---|---|---|
| 4,798,064 | A | 1/1989 | Elsasser et al. |
| 4,930,637 | A | 6/1990 | DeRoseau |
| 5,456,351 | A | 10/1995 | Johnson |
| 5,695,084 | A | 12/1997 | Chmela et al. |
| D602,775 | S | 10/2009 | Shale |
| 2007/0062948 | A1 | 3/2007 | Albrecht et al. |
| 2009/0184120 | A1 | 7/2009 | Stevens |
| 2010/0051631 | A1 | 3/2010 | Blomdahl et al. |

OTHER PUBLICATIONS

Wells Enterprises, Inc., PCT/US12/24235 filed Feb. 8, 2012, "Notification of Transmittal of International Search Report and Written Opinion of the International Searching Authority" mailed Jun. 6, 2012.

*Primary Examiner* — Mickey Yu
*Assistant Examiner* — Niki Eloshway
(74) *Attorney, Agent, or Firm* — McKee, Voorhees & Sease

(57) ABSTRACT

A container assembly for holding, shipping, and consuming a product, such as a frozen confection, is provided. The container assembly includes a container, a lid, and a utensil. The utensil is connected to the assembly so that a consumer is able to spoon the product from the container. A consumer may purchase the assembly containing a product, open the container, remove the utensil, and consume the product using the self-contained utensil. The assembly may also include a membrane for ensuring freshness and to indicate tampering of the product. The utensil may be attached directly to the lid, or in a pocket between sealed membranes.

20 Claims, 10 Drawing Sheets

PERSONAL SIZE CONTAINER

FIELD OF THE INVENTION

The present invention relates generally to an improved container. More specifically, but not exclusively, the invention relates to a container for holding, shipping, and storing a product, such as a frozen confection, and an integrated utensil for use with consuming the product. However, other products besides a frozen confection may be held, stored, and shipped in the container.

BACKGROUND OF THE INVENTION

Product, such as a frozen confection and including ice cream, can be packed, stored, and shipped in many forms of containers. Many containers are sized to hold enough product for providing multiple servings for several people. However, it is sometimes desirable to provide a container having a fewer number of servings, and even a single serving of a product, such as ice cream. These containers are often referred to as personal size or single serving containers.

Personal size or personal serving containers have many advantages. The containers generally contain a proportioned amount of product sufficient to satisfy one consumer during one consumption. The containers fit people's on the go lifestyles, consist of little to no waste, and are generally easy to use. However, problems still remain with many of the containers. For instance, many of the containers do not include a utensil, such as a spoon, with the container. The consumer would have to have access, or remember a spoon to actually consume the product. This can be bothersome when the consumer may decide on a whim to purchase the product and not have access to any utensils.

Problems also exist for product containers that do include a utensil. For instance, the utensils are undersized, under designed and inadequate for eating a frozen product, such as ice cream. To incorporate a utensil into a container or lid, many manufacturers add additional room and/or ridges to their containers, which can substantially add to the amount of product needed to manufacture each container. The additional material is expensive, especially in the case of high production volumes.

Therefore, there is a need in the art for a container that includes a utensil, such as a spoon for eating product, such as ice cream, that overcomes the deficiencies in the prior art. There is also a need for a personal-sized container and spoon combination to allow an individual to consume product anywhere and anytime, and while on the go.

SUMMARY OF THE INVENTION

It is therefore a primary object, feature, and/or advantage of the present invention to provide an improved container that overcomes the deficiencies in the prior art.

It is another object, feature, and/or advantage of the present invention to provide an improved container that includes a utensil in a lid without adding a substantial amount of material for production of the product.

It is another object, feature, and/or advantage of the present invention to provide an improved container equipped with tamper proof evidenced features.

It is another object, feature, and/or advantage of the present invention to provide an improved container that includes a sufficiently rigid utensil for removing frozen product from the container.

It is another object, feature, and/or advantage of the present invention to provide an improved container that is sized to hold a single serving of product.

It is another object, feature, and/or advantage of the present invention to provide an improved container that includes features shaped to coincide and accent with the size, shape, color combinations, texture, and graphics of the product packaging of the container.

Other objects, features, and advantages of the present invention will become apparent to those skilled in the art. The present invention is not to be limited to or by these objects, features and advantages, and no single embodiment need exhibit every object, feature, and advantage.

According to one aspect of the present invention a lid and utensil assembly is provided. The assembly includes a lid and a one-piece rigid utensil. The lid has a continuous inner wall, a side wall formed around and extending generally perpendicularly from the inner wall, a non-continuous seal rib formed on the interior of the side wall and extending around the periphery of the side wall forming one or more vents, and an attachment member extending downwardly from the inner wall and including a lip surrounding a distal end of the attachment member. The utensil has a cup-shaped portion and a handle, the cup-shaped portion having a convex side, a plurality of strengthening ribs extending from the convex side of the cup-shaped portion substantially the length of the handle, and an aperture through the handle. The attachment member of the lid is adapted to engage the aperture such that the utensil is selectively secured to and removed from the lid.

According to another aspect of the present invention, a container, lid, and utensil assembly is provided. The assembly includes a container, a lid, and a one-piece rigid utensil. The container has a base, an integral sidewall extending upward from the base and forming a continuous sidewall around the base, an upper seal rim at an upper portion of the sidewall for engaging a lid, and a container skirt around an outside portion of the sidewall between the sidewall and the upper seal rim. The lid has a continuous inner wall, a side wall formed around and extending generally perpendicularly from the inner wall, a non-continuous seal rib formed on the interior of the side wall and extending around the periphery of the side wall forming one or more vents and adapted to engage the upper seal rim of the container, and an attachment member extending downwardly from the inner wall and including a lip surrounding a distal end of the attachment member. The utensil has a cup-shaped portion and a handle, the cup-shaped portion having a convex side, a plurality of strengthening ribs extending from the convex side of the cup-shaped portion substantially the length of the handle, and a utensil aperture through the handle. The attachment member of the lid is adapted to engage the aperture such that the utensil is selectively secured to and removed from the lid.

According to yet another aspect of the present invention, a container, lid, and utensil assembly is provided. The assembly includes a container, a lid, a heat-sealed pouch, and a one-piece rigid utensil. The container has a base, an integral sidewall extending upward from the base and forming a continuous sidewall around the base, an upper seal rim at an upper portion of the sidewall for engaging a lid, and a container skirt around an outside portion of the sidewall between the sidewall and the upper seal rim. The lid has a continuous inner wall, a side wall formed around and extending generally perpendicularly from the inner wall, a non-continuous seal rib formed on the interior of the side wall around the periphery of the side wall forming one or more vents and adapted to engage the upper seal rim of the container. The pouch is attached to the upper seal rim of the container, the pouch comprising a first membrane continuously attached to the upper seam rim, and a second membrane connected to the first membrane to create a pocket between the first and second membranes. The one-piece rigid utensil has a cup-shaped portion and a handle, the cup-shaped portion having a convex side, a plurality of strengthening ribs extending from the convex side of the cup-shaped portion substantially the length of the handle, with the utensil positioned in the pocket between the first and second membranes of the heat-sealed pouch.

DETAILED DESCRIPTION OF THE PREFERRED EMBODIMENTS

FIGS. 1-19 show an embodiment of a container, lid, and utensil assembly 10 of the present invention. The assembly 10 includes a container 12, a lid 42, and a utensil 60 in connection with one another. It is preferred that the container 12, lid 42, and utensil 60 be made of food grade polypropylene, however, any other type of food grade material can be used with this invention. The container is a personal size container to aid in a person's on-the-go lifestyle. Because of the size and design of the container, it can be used more than once, which allows for little to no waste.

Figure 1:
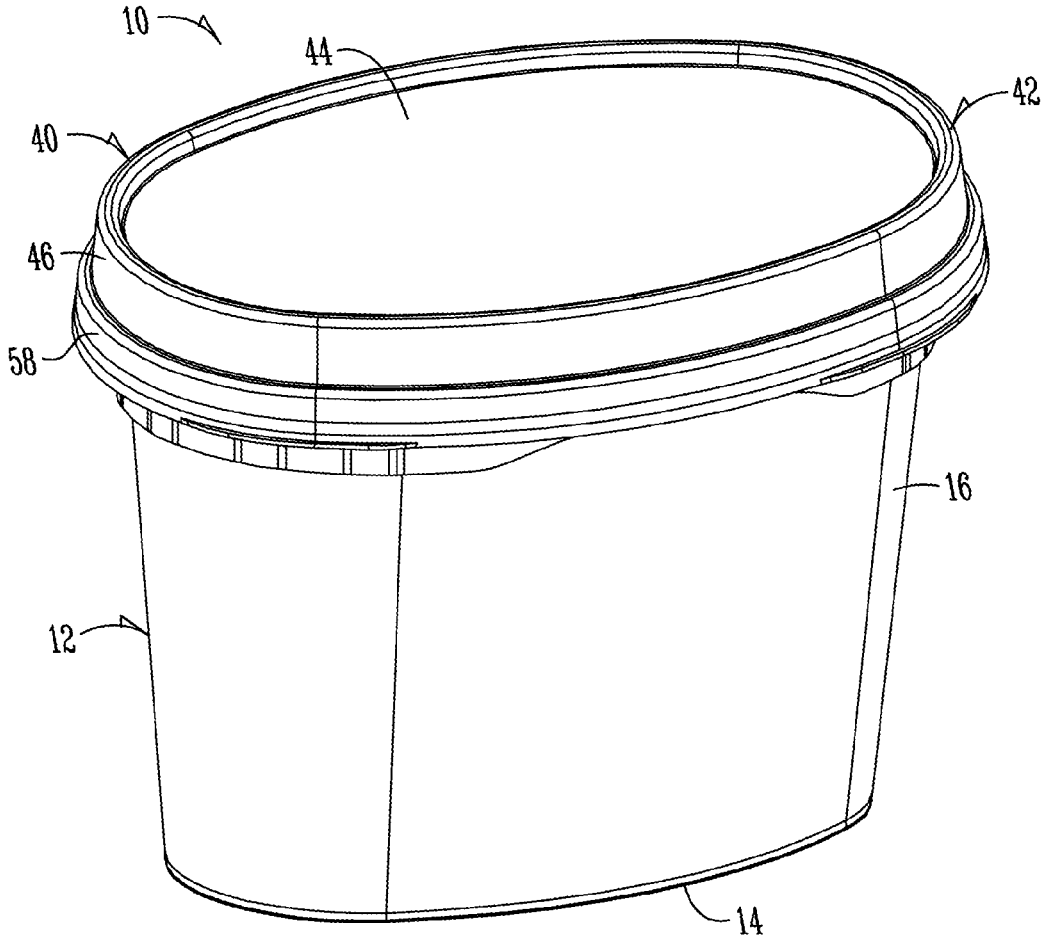
FIG. 1 is a perspective view of one embodiment of a container and lid of the present invention.
Figure 4:
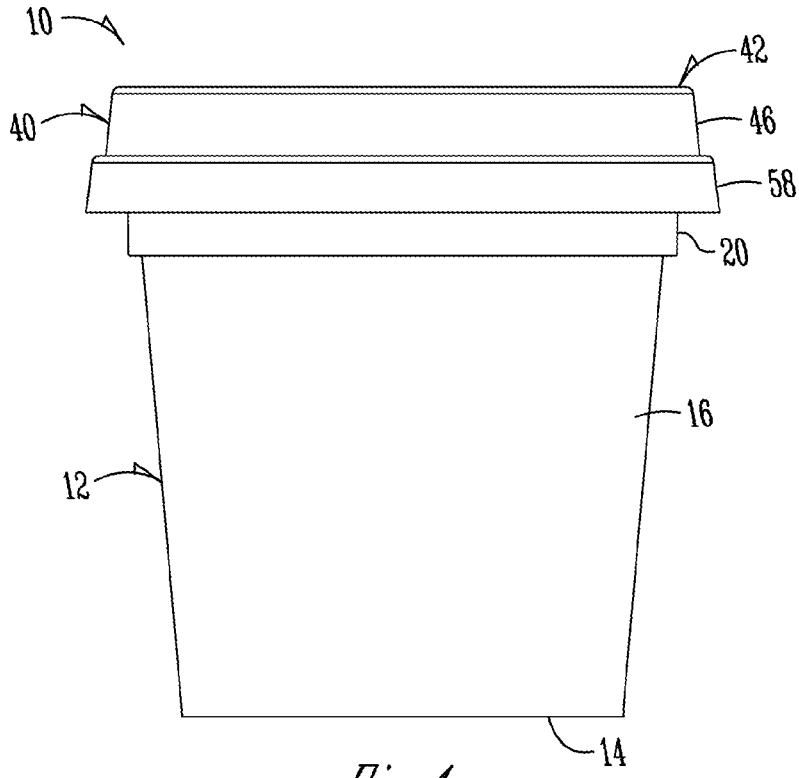
FIG. 4 is a side view of the container and lid of FIG. 1.

FIGS. 1-4 show views of the assembly 10 with the lid 42 connected to the container 12. The utensil 60 is connected within the container/lid assembly, and is out of sight when the lid and container are connected. The container 12 includes a base 14. A sidewall 16 extends upward from the base 14 and around the base, thereby creating a product holding portion of the container 12. While the sidewall 16 can take any shape, the assembly 10 is generally oval shaped, as shown in FIG. 1. The oval shape allows for easier removal of contents from within product holding portion of the container 12. Additionally, as shown in FIGS. 2A and 4, the sidewall 16 of the container is slightly tapered. The taper of the sidewall allows for ease of molding the container 12, removing the entirety of the product, as well as stacking or nesting empty containers. As will be mentioned below, the lid 42 includes similarly tapered sides to allow for the same stacking or nesting of lids while not in use or during storage.

FIGS. 2B and 5-7 show the container 12 without the lid 42 attached thereto. In addition to the base 14 and sidewall 16, the container 12 includes an upper seal rim 18 located at an upper portion of the sidewall, and a container skirt 20 positioned between the sidewall 16 and the upper seal rim 18. Both the upper seal rim 18 and the container skirt continuously surround the sidewall 16 of the container 12. However, it should be noted that the container skirt 20 does include an arcuate-shaped cutout 22 at the front and back sides of the container 12. The arcuate-shaped cutout 22 extends through the entirety of the container skirt 20. The cutout 22 is designed to match and accent the size, shape, color combinations, contour, texture, and other graphics of product packaging (not shown) on the sidewall 16 of the container 12. For instance, when the container 12 is used to hold a frozen confection, such as ice cream, the cutout 22 may be designed to match the size and shape of a scoop of ice cream, which may be shown on the product packaging for the container 12. The cutout 22 and other features may be used to accentuate the features of the contents of the container, as well as to enhance the trade dress of the container 12.

Figure 2A:
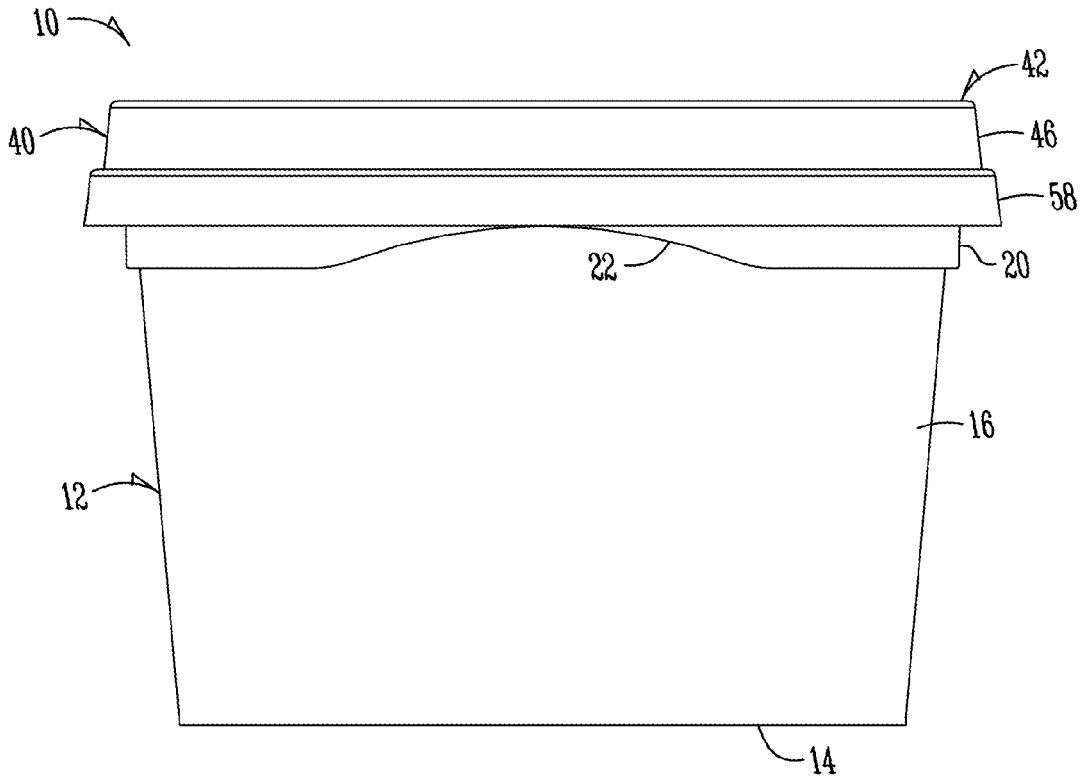
FIG. 2A is a front view of the container and lid of FIG. 1.
Figure 2B:
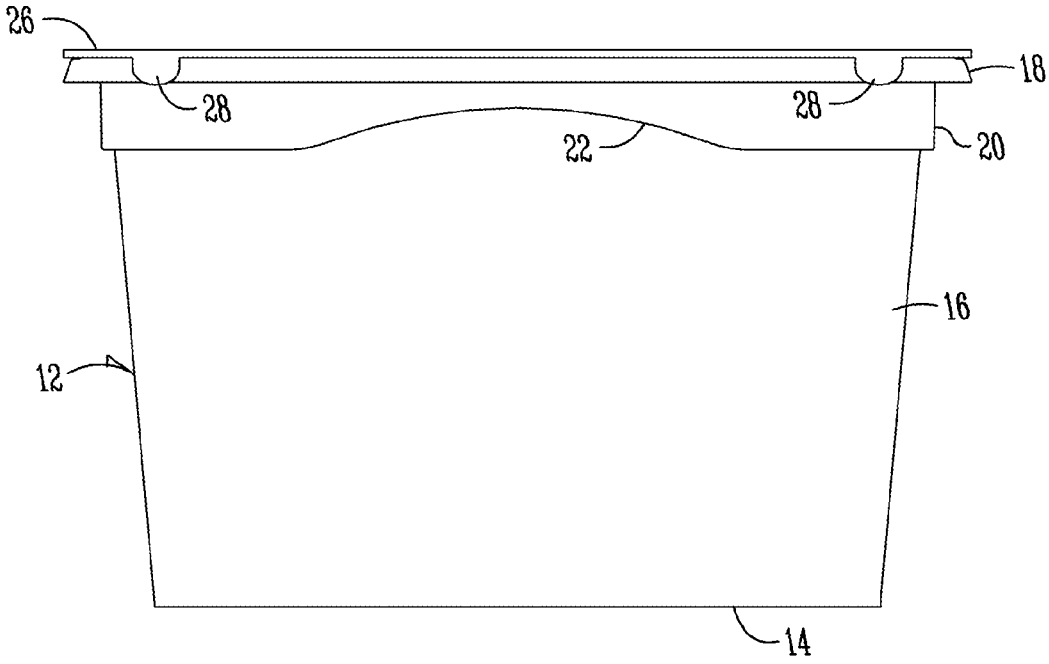
FIG. 2B is a front view of the container without the lid.
Figure 3:
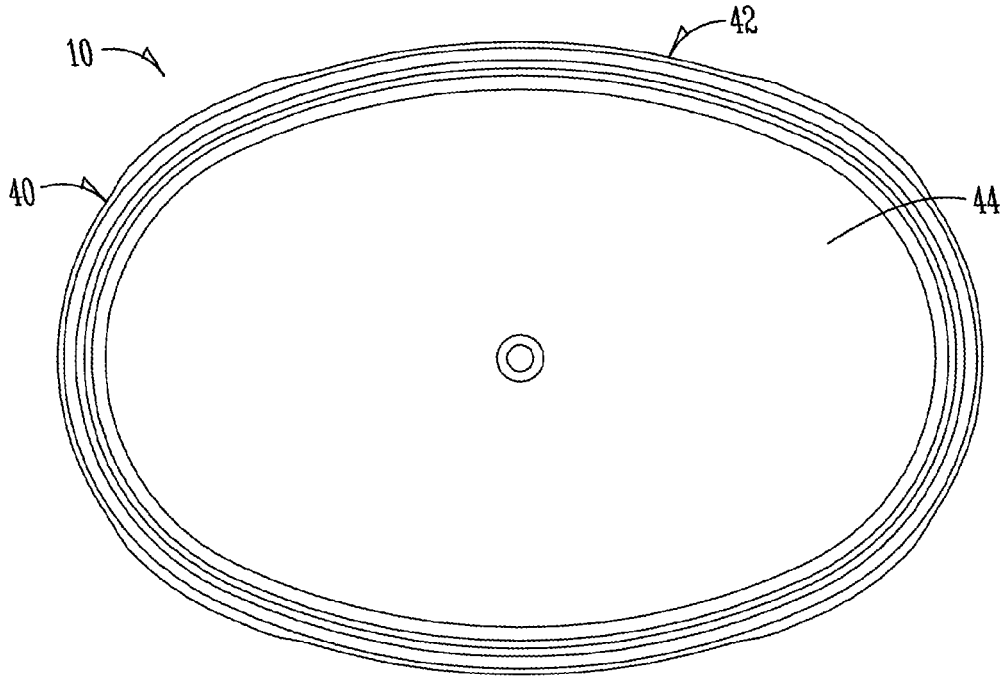
FIG. 3 is a top view of the container and lid of FIG. 1.

FIG. 2B shows an embodiment of the container 12 including a membrane 26 attached to the upper seal rim 18. The membrane 26 is connected to the container 12 to ensure that the product or contents of the container stay fresh, as well as to allow a consumer to know if the container has been tampered with in some manner. The membrane may be a wax-coated foil material and is attached to the upper seal rim 18 by a glue or other adhesive, by heat sealing, or by another manner that will not affect the contents of the container, while also sealing the membrane 26 to the container 12. Furthermore, the membrane 26 includes a plurality of tabs 28 spaced around the peripheral edge of the membrane. The tabs 28 allow a consumer to remove the membrane 26 by pulling on the tabs away from the container 12. Therefore, it should also be noted that the membrane 26 is frangibly connected to the container 12 such that the connection may be broken without the need of substantial force. For example, the membrane may be a peel-off or tear-away membrane that is easily removable from the container.

Figure 5:
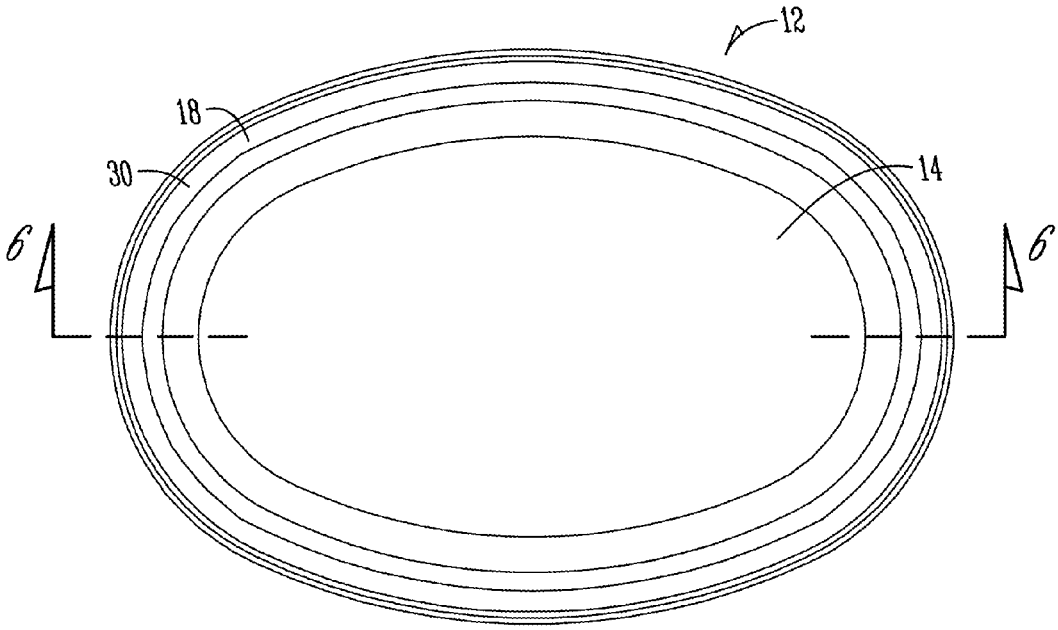
FIG. 5 is a top view of one embodiment of the container of the present invention.
Figure 6:
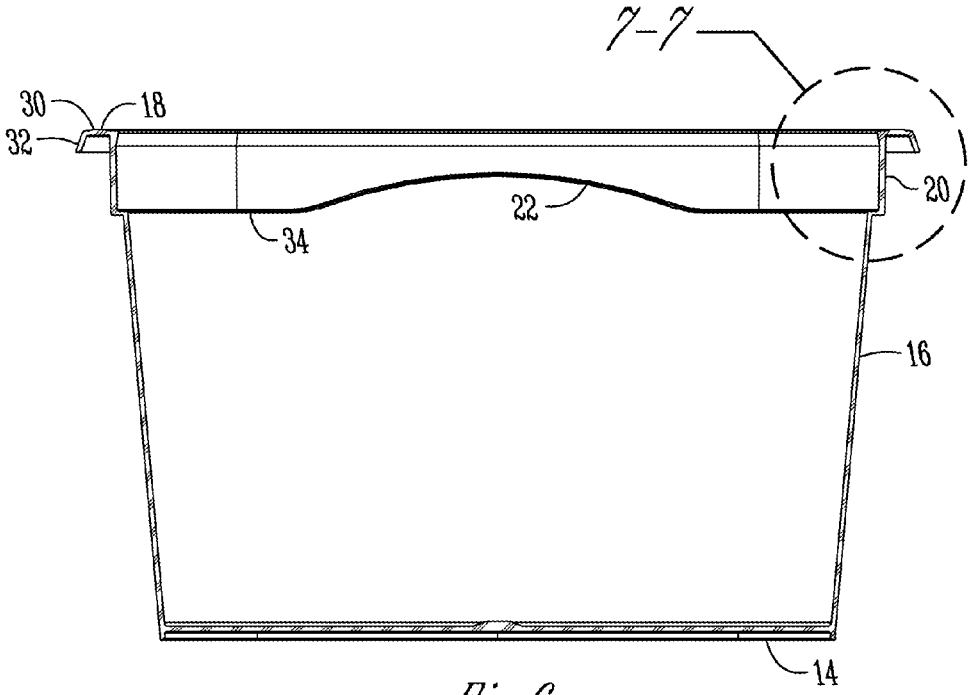
FIG. 6 is a sectional view of the container according to line 6-6 of FIG. 5.
Figure 7:
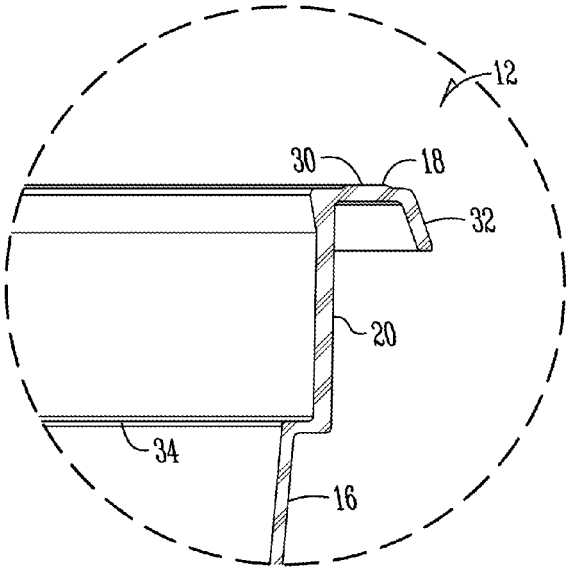
FIG. 7 is an enlarged view of a portion of the container of FIG. 6.

As shown in FIG. 5, the upper seal rim 18 of the container comprises a surface 30 that is substantially planar. The surface 30 allows an abutment with the lid 42 such that the surface does not allow the contents of the container 12 to be able to spill over the upper seal rim 18 and down the sidewall 16. FIG. 6 is a sectional view of the container 12 of FIG. 5 taken along line 6-6. FIG. 6 shows a fill line 34 generally set below the surface 30. Filling the container 12 to a fill line 34 below the surface 30 or top of the upper seal rim 18 allows the contents to slightly expand without damaging the container 12 or spoiling the contents. This is important when the filled containers are shipped to areas with either greater or less atmospheric pressure, which can cause the contents to expand or shrink. FIG. 7 is an enlarged view of a portion of the section of the container 12 of FIG. 6. FIG. 7 shows an area of the upper portion of the container, showing the container skirt 20 and the upper seal rim 18. The figure also shows how both the sidewall 16 and the container skirt 20 are tapered, or slightly sloped, as mentioned above. FIG. 7 shows how the upper seal rim 18 includes both the substantially planar top surface 30, as well as a container lip 32 extending generally downward from the surface 30. The container lip 32 surrounds the full periphery of the container 12, and connects and holds the lid 42 to the container 12. It should be noted, however, that the lip 32 does not extend below the container skirt 20 or the container cutout 22 so that it will not block the product packaging of the container 12.

Figure 8:
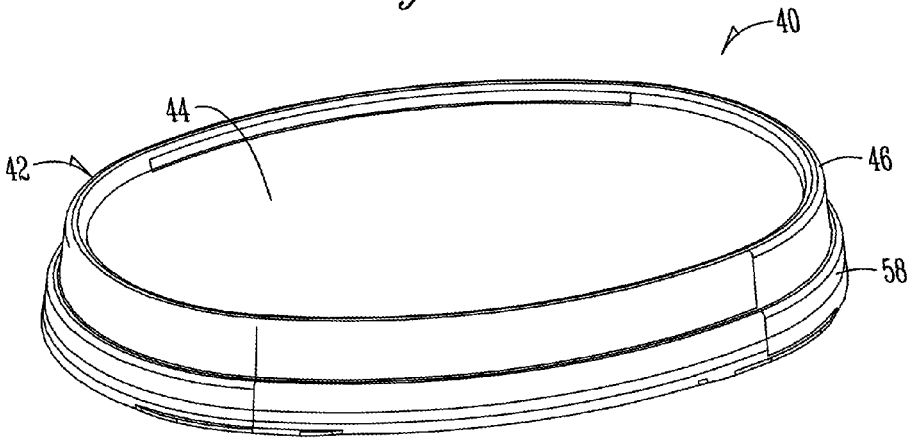
FIG. 8 is a top perspective view of one embodiment of a lid of the present invention.
Figure 9:
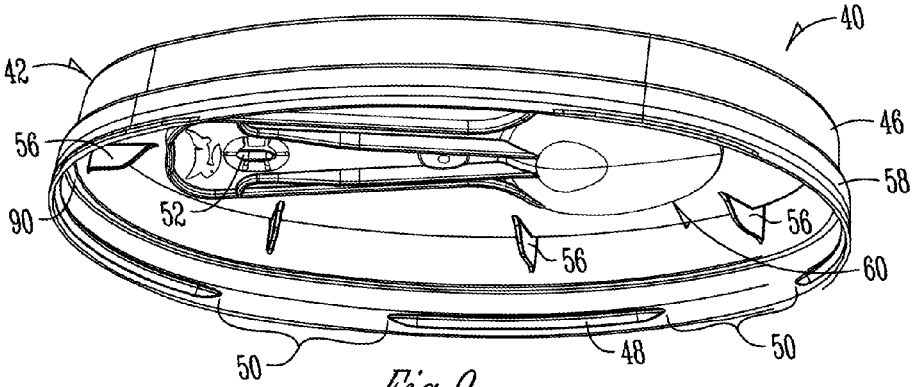
FIG. 9 is a bottom perspective view of the lid of FIG. 8 with a utensil attached.

FIGS. 8-13 show various views of a preferred embodiment of a lid 42 of the present invention. FIGS. 8 and 9 are top and bottom perspective views of the lid and utensil assembly 40. The lid 42 is comprised of an inner wall 44 being generally oval shaped. However, it should be noted that the shape of the inner wall does not have to be oval, but it should match the shape of the base 14 of the container 12. A side wall 46 extends generally downward from the inner wall 44. It may be preferred to also extend the skirt 46 slightly upward from the inner wall 44 to allow for easier stacking of lids. Additionally, while the skirt 46 extends generally downward, it will also extend slightly outwardly from the inner wall 44 such that lids are to be more easily molded and stacked. The side wall 46 extends completely around the inner wall 44, however. In a preferred embodiment, a lid skirt 58 will extend generally downwardly and slightly outwardly from the side wall 46. The lid skirt 58 is extended away from the inner wall 44 to aid in molding and stacking of lids. The inner wall 44, side wall 46, and lid skirt 58 form a one-piece lid, which may be molded. However, it should be appreciated that the lid skirt 58 is not required in all embodiments, and that the length of the side wall 46 or the lid skirt 58 may be adjusted to best fit the lip 32 of a container 12.

It should be noted, when both a side wall and a lid skirt 46,58 are provided, the offset of the two skirts creates a lid skirt ridge 90. This is shown in FIGS. 9-13. The ridge 90 is substantially planar, as shown in FIGS. 11 and 12. When the lid 42 is connected to the container 12, the rim seal surface 30 will abut tightly against the lid skirt ridge 90. This abutment prevents product from being able to leak from the container, and ensures that the lid remains tightly connected to the container.

Figure 10:
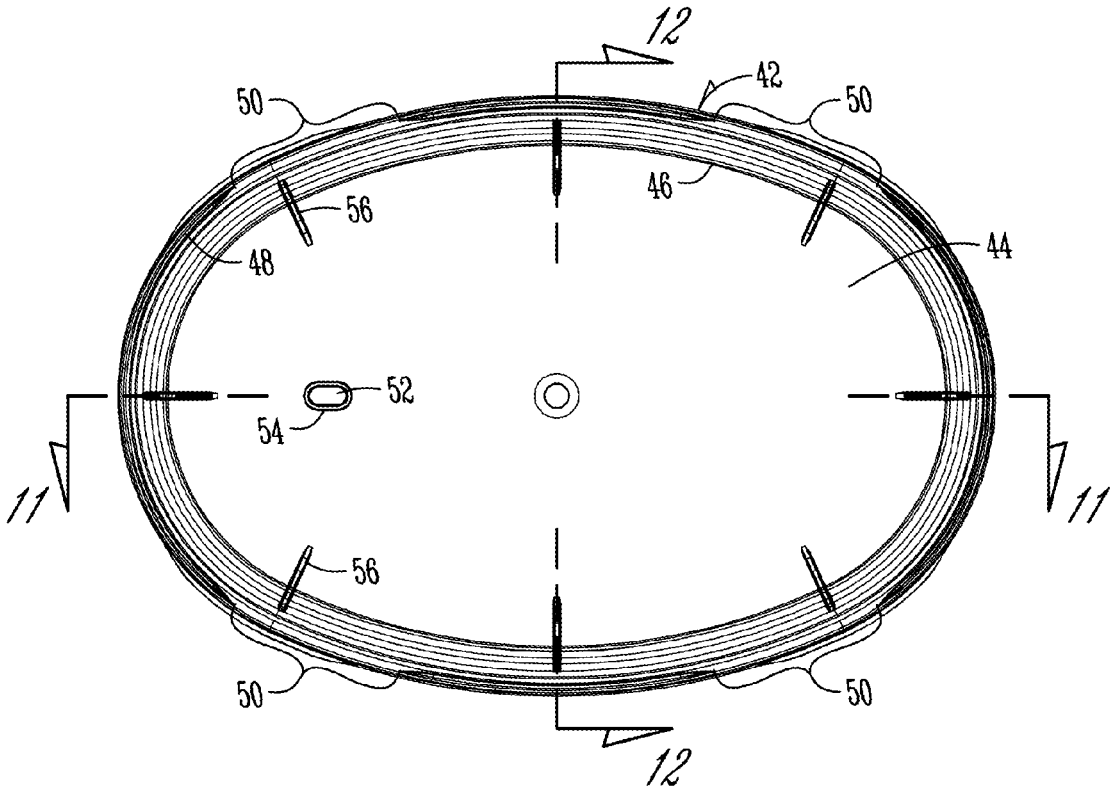
FIG. 10 is a bottom view of the lid of FIG. 8.
Figure 11:
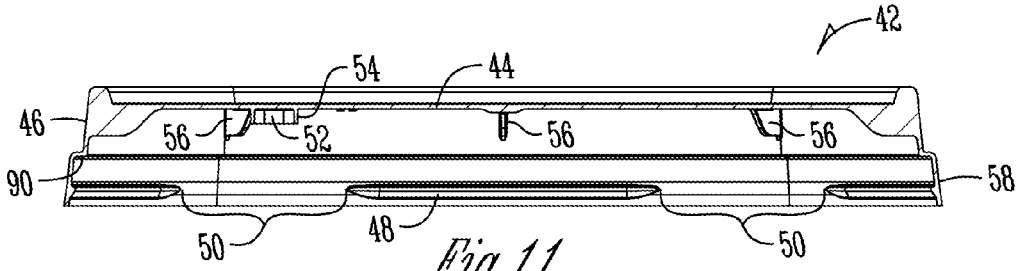
FIG. 11 is a front sectional view of the lid of FIG. 10 along line 11-11.
Figure 12:
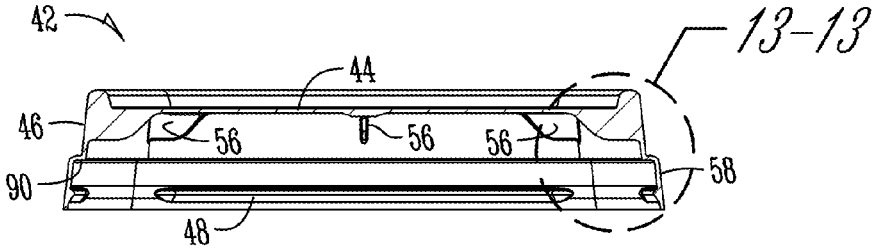
FIG. 12 is a side sectional view of the lid of FIG. 10 along line 12-12.
Figure 13:
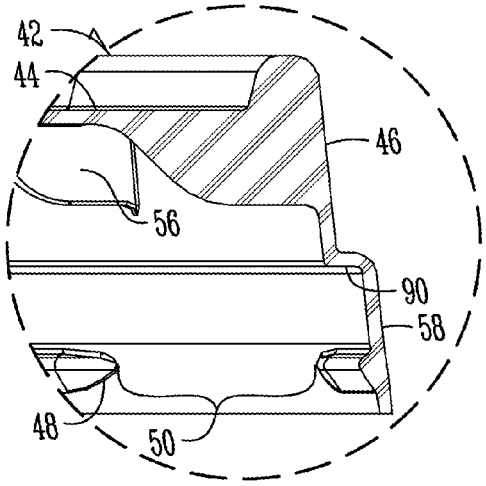
FIG. 13 is an enlarged view of a section of the lid of FIG. 11.
Figure 14:
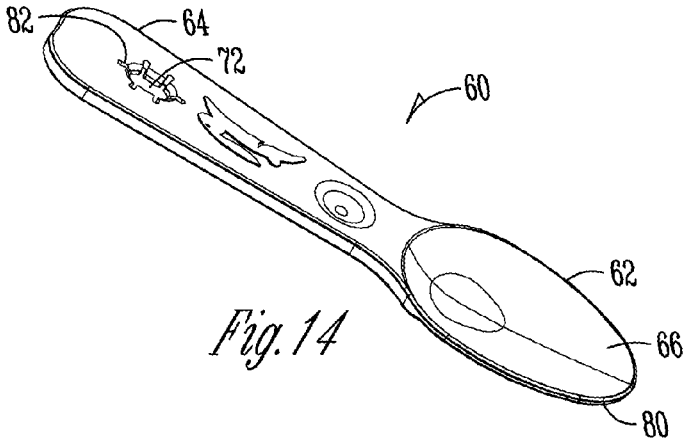
FIG. 14 is a top perspective view of one embodiment of a utensil according to the present invention.
Figure 15:
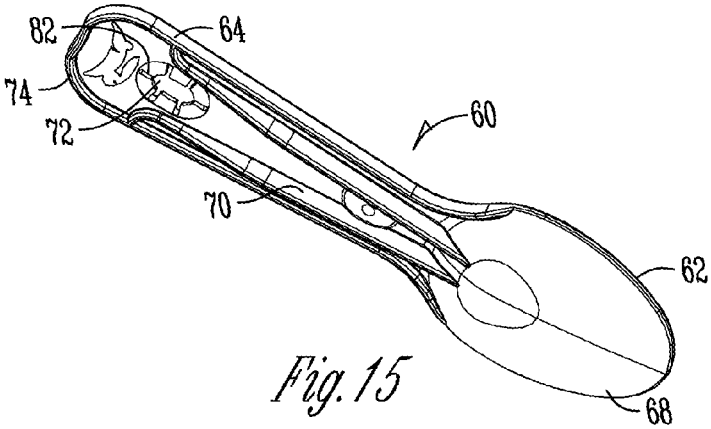
FIG. 15 is a bottom perspective view of the utensil of FIG. 14.

As shown in FIGS. 9-13, the bottom side of the lid 42 may also include a non-continuous seal rib 48, an attachment member 52, and a plurality of side wall ribs 56. The non-continuous seal rib 48 is located around the inner periphery of either the side wall or lid skirt 46,58. The seal rib 48 is a small protrusion extending inwardly around one of the lid skirts. The seal rib 48 is used to engage the rim seal lip 32 of the container 12 to connect the lid 42 to the container. The flexibility of the material of the lid 42 allows the seal rib 48 to expand outwardly to go over the lip 32, while the elasticity and shape of the material brings the rib 48 back towards the sidewall 16 to provide a tight connection around the upper seal rim 18 of the container. As shown in FIGS. 9-11, however, the seal rib 48 is not continuous about the full inner periphery of the lid 42. The break in continuity of the rib creates vents 50 between the lid 42 and the upper seal rim 18 of the container 12. The vents 50 allow air to move in and out of the container 12 as air pressure increases or decreases during transport. For instance, when a container that is full of product to about the fill line 34 and is transported to lower pressure areas, such as high altitudes, the pressure created in the lid 42 can escape. This prevents either air or expanding product in low pressures from popping the lid 42 off of the container 12 at the low pressure areas. However, when going to high pressure areas, air cannot enter through the vents 50 because the pressure in the high pressure areas actually pushes the lid 42 tighter onto the container 12 preventing air from entering under the lid.

Additionally, a plurality of side wall ribs 56 are shown on the underside of the lid 42 extending from the inner wall 44 to the side wall 46. The side wall ribs 56 have a thin width and height not to exceed generally the height of the side wall 46. The ribs 56 are spaced around the inner periphery of the side wall 46 to add structural integrity to the lid 42. In the case of only a side wall 46, the side wall ribs 56 will not extend to the end of the skirt 46 so that the lower end of the skirt maintains its flexibility for connecting the lid to the container. However, the side wall ribs 56 allow the lid to not collapse upon itself, while also ensuring a space for the utensil 60 to fit within the lid, as will be discussed below. When both a side wall and lid skirt 46,58 are used, the side wall ribs 56 do not extend beyond the height of the side wall so that the lid skirt maintains its flexibility to connect to the lip of the upper seal rim 18 of the container 12. The side wall ribs 56 may be molded as part of the lid, and are evenly spaced around the inner periphery of the lid to ensure that the upper part of the lid is not collapsible and also so that a sufficient space remains to fit the utensil in connection with the lid. It should be appreciated that the size and number of the side wall ribs 56 may vary depending on the size, shape, and material of the lid.

FIG. 9 is a bottom perspective view of the lid 42 showing the utensil 60 attached to the lid to form a lid assembly 40. The utensil 60 is stored in connection with the lid 42 during transport of filled containers, or whenever a consumer needs a place to put the utensil. To connect the utensil 60 to the lid 42, an attachment member 52 extends downwardly a short distance from the inner wall 44 of the lid. At the distal end of the attachment member 52 is a lip or ridge 54 around the end of the member. The lip 54 is sized commensurate with the aperture 72 in the utensil 60 to hold the utensil 60 in place when connected to the lid 42. The attachment member 52 is positioned on the inner wall 44 such that the utensil 60 is able to fit against the inner wall so that the utensil is able to fit into the smallest amount of area as needed. This will keep the cost of material to a minimum.

FIGS. 14-19 show an embodiment of a utensil 60 used with the assembly 10 described thus far. The utensil 60 is a one-piece or single-piece rigid component comprising a cup-shaped portion 62 and a handle 64. The cup-shaped portion 62 includes a concave side 66 and a convex side 68. The concave side 66 of the utensil 60 has an edge 80 that is substantially planar with the handle 64. Furthermore, the utensil has a length L, generally designated by reference numeral 76. It should also be noted that the handle is longer than the length of the cup-shaped portion. The overall length 76 of the utensil is greater than the distance between the base 14 and the upper seal rim 18 of the container 12.

Figure 16:
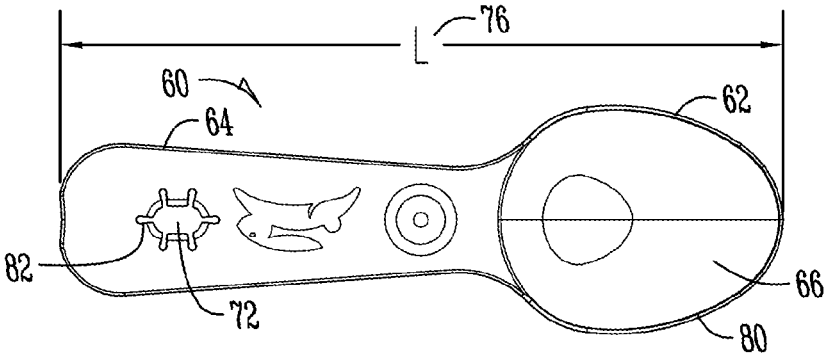
FIG. 16 is top view of the utensil of FIG. 14.

FIG. 16 shows a top view, or a view of the concave side 66 of the utensil 60. The cup-shaped portion 62 and the handle 64 are made of one piece of material. For instance, the utensil 60 could be molded, just as the rest of the assembly 10. FIG. 16 also shows that the aperture 72 is positioned through the handle 64. While the exact location of the aperture 72 on the handle may vary depending on the location of the attachment member 52 on the lid 42, it is preferred to have the aperture through the handle and not the cup-shaped portion. The figures also show that the aperture 72 has a plurality of slots 82 extending from and radially spaced about the aperture. The slots 82 allow the material around the aperture to be flexible such that they can bend to allow the aperture to fit around the lip 54 of the attachment member 52 on the lid. However, it should be noted that the material of the utensil is rigid enough to bend back into place, such that the utensil 60 stays connected to the lid 42, even when substantial force is applied to the lid or anywhere else on the container assembly 10.

Figure 17:
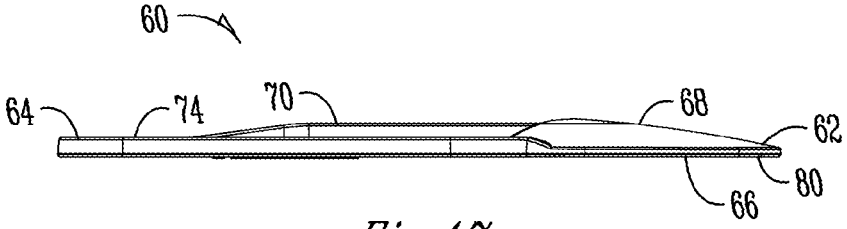
FIG. 17 is a front view of the utensil of FIG. 14.
Figure 18:
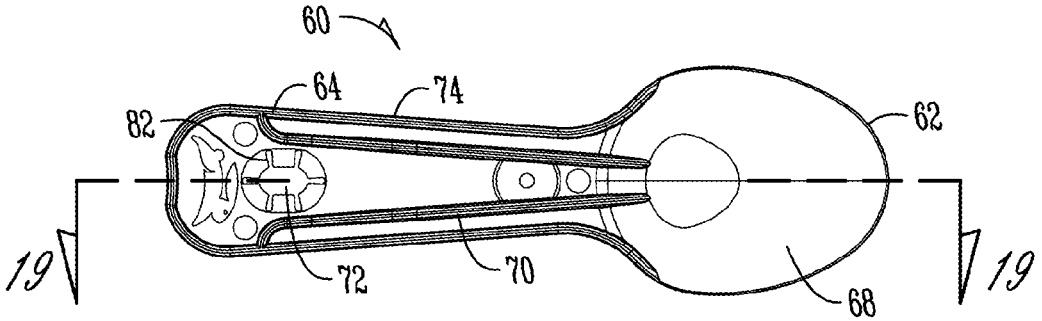
FIG. 18 is a bottom view of the utensil of FIG. 14.
Figure 19:
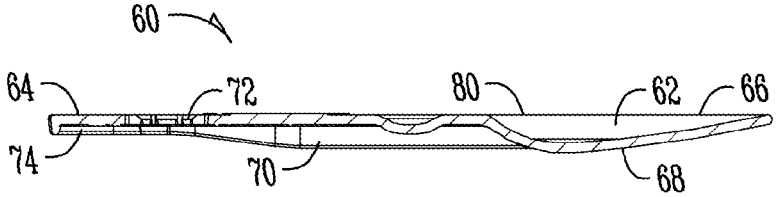
FIG. 19 is a sectional view of the utensil of FIG. 14 along line 19-19.

FIGS. 17-19 show details of the convex side 68 of the utensil 60. As is shown in FIGS. 17 and 19, the concave side 66 of the utensil, including both the cup-shaped portion 62 and the handle 64 is generally planar. This allows the utensil to be connected to the lid 42 on the concave side so as to take up as little room a possible within the lid. The convex side 68 shows that the cup-shaped portion extends outwardly from the edge 80. There is also a ridge 74 around the handle 64 that extends from the concave side 62. Furthermore, there is a plurality of strengthening ribs 70 extending from the cup-shaped portion 62 to a part of the handle 64. The strengthening ribs 70 and ridge 74 increases the rigidity and strength of the utensil 60. This allows the utensil to be able to remove frozen product from the container 14 without breaking. It should be appreciated by those in the art that the height and thickness of the ridge and ribs 70,74 will be dependent on the type of material used to create the utensil. Additionally, the size of the cup-shaped portion may be varied depending on the type of product the utensil 60 is intended to be used with as well. However, the depth of the cup-shaped portion 62 and the height of the ridge and ribs 70,74 are kept to a minimum, so that the utensil is able to take as little space as possible in the lid 42 so that little to no extra material is required to mold or form the lid and the utensil. This will keep the costs of production to a minimum. It is preferred that the lid be manufactured to fit within the size of existing lids.

Figure 20:
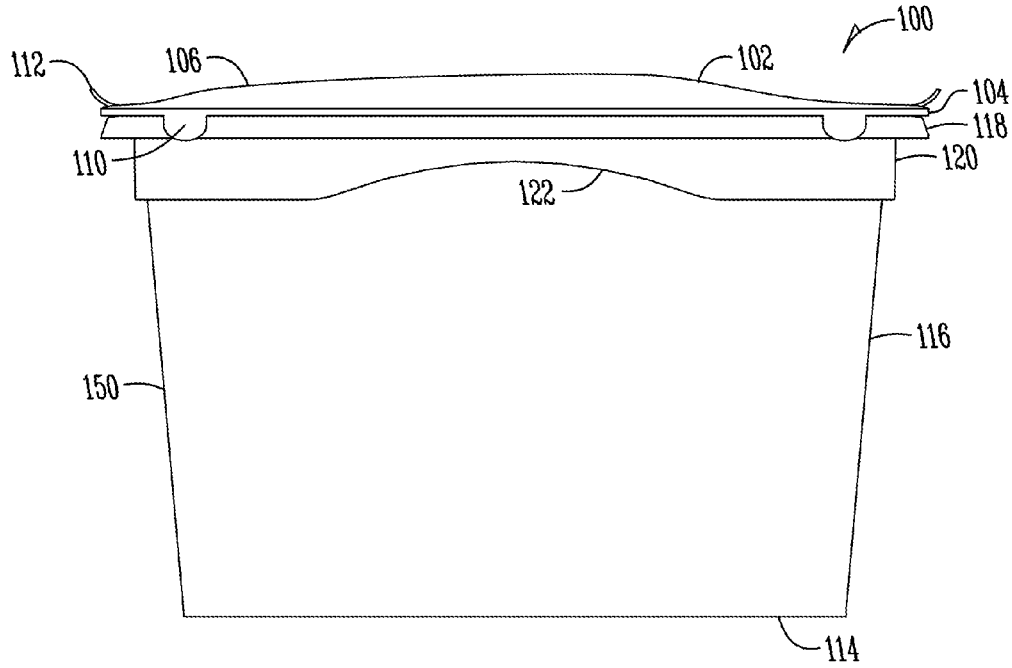
FIG. 20 is a front view of one embodiment of a container according to the present invention and including a pouch holding a utensil.
Figure 21:
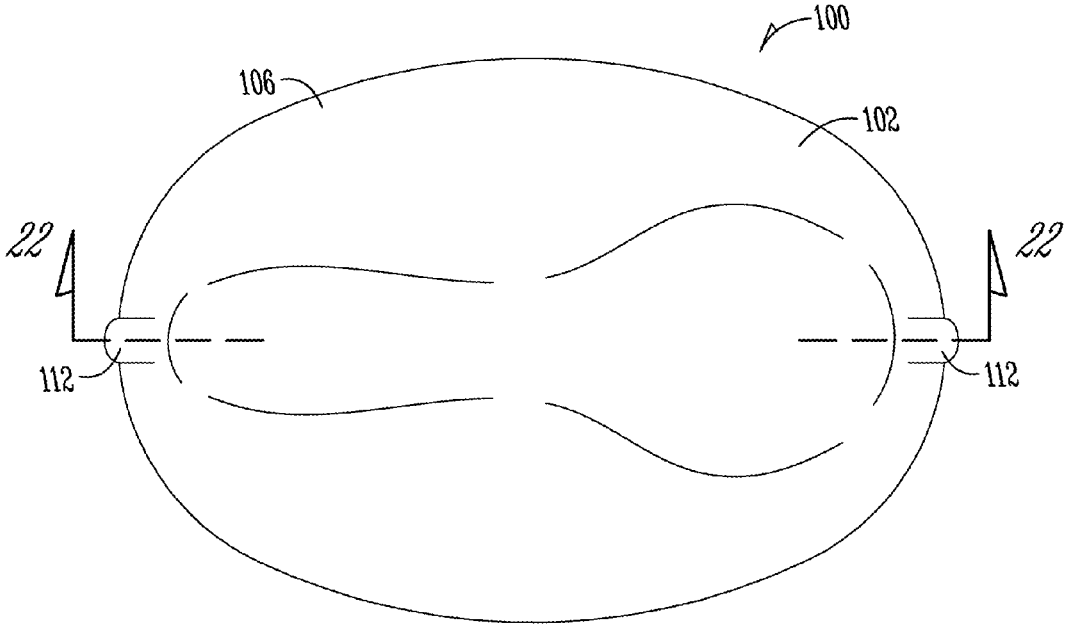
FIG. 21 is a top view of the container of FIG. 20.
Figure 22:
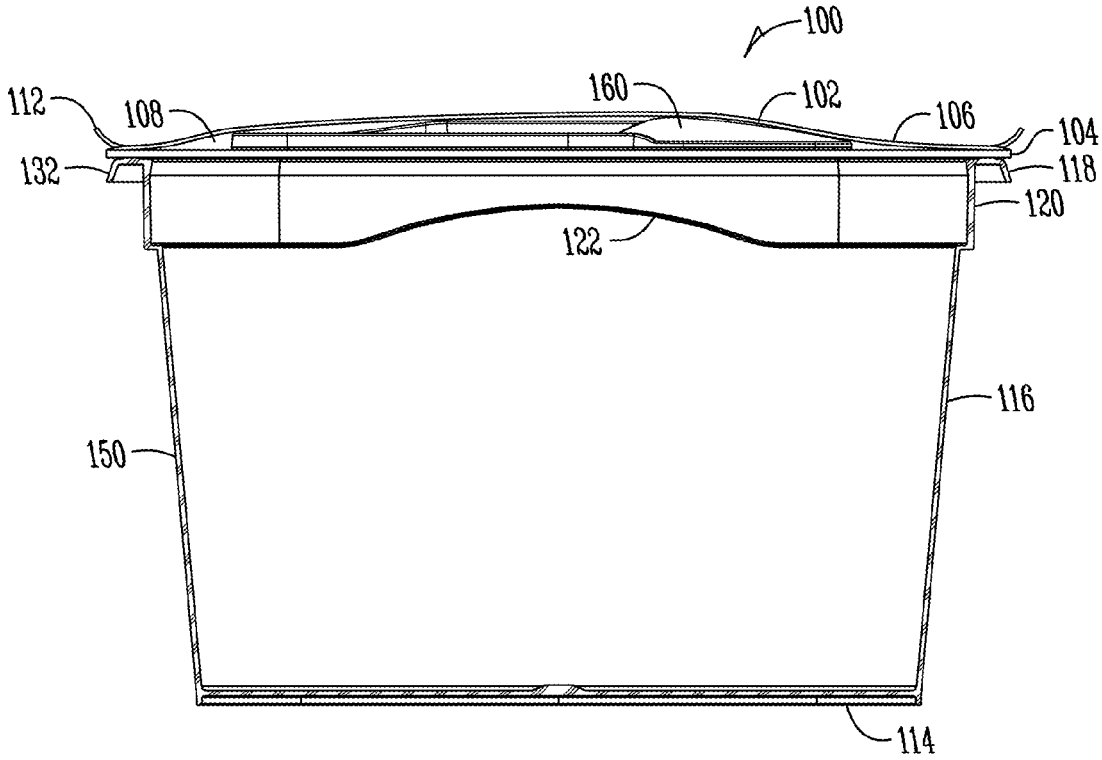
FIG. 22 is a sectional view of the container of FIG. 21 along line 22-22.

FIGS. 20-22 shown another embodiment of the present invention, wherein a utensil 160 is included with a container assembly 100 for holding a product. The assembly 100 includes a container 150, similar to the container 12 discussed above. The container includes a base 114, a sidewall 116, an upper seal rim 118, a container skirt 120, and a container cutout 122. While a lid is not shown in FIGS. 20-22, it should be appreciated that a lid similar to the lid 42 described above may be used with the assembly 120. However, an attachment member 52 is not required in this embodiment.

The assembly 100 further includes first and second membranes 104,106. The membranes may comprise a foil, or another material known in the art for use as seals for keeping products safe and fresh. The first membrane is attached to the upper seal rim 118 similarly to the manner in which the membrane 26 is attached to the container 12, as described above. The first membrane 104 further includes first membrane tabs 110 for removing the membrane from the upper seal rim 118. Attached to the first membrane 104 is a second membrane 106. The second membrane 106 is heat-sealed around its edges to form a pocket 108 between the first and second membranes, respectively. A utensil 160 is placed between the two membranes before the second membrane is heat-sealed so as to be positioned in the pocket 108. FIG. 22 shows the arrangement. FIG. 22 is a sectional view of the assembly 100 along line 22-22 of FIG. 19. FIG. 22 shows that the pocket may be the full size of the top of the container. However, a smaller pocket close to the size of the utensil 160 may be used to limit the cost of materials.

Furthermore, as shown in FIGS. 20-22, the first membrane 104 includes first membrane tabs 110, and the second membrane 106 may include second membrane tabs 112. In use, after the lid is removed from the assembly 100, a consumer would use the first membrane tabs 110 to pull the first membrane 104 away from the upper seal rim 118 of the container. The user would then keep hold of the first membrane tabs, but also grab the second membrane tabs 112 to pull the first and second membranes away from one another. This will break the heat-sealed connection, and will allow the consumer access to the pocket 108 to be able to use the utensil 160. However, it should be appreciated that the second tabs 112 may not be needed. A material could be used for the membranes such that a consumer is able to tear or cut the membranes to gain access to the pocket between the two membranes 104,106. In addition, a portion of one of the membranes may contain a pre-cut slot to allow for an easier tearing of the membranes.

The foregoing embodiments describe container assemblies that allow a consumer to obtain product, such as a frozen confection, from a container at anytime and anywhere. The consumer does not require access to a utensil, such a spoon. A utensil may be snap fit into a lid of a container, or enclosed in a pocket between membranes used for sealing the container. Furthermore, the snap fit allows for re-use of the utensil and container. The utensil can be re-snapped to the lid, the components cleaned, and the container refilled with a product of the consumers choice. Therefore, the present invention also discloses a reusable container for storing a product to be used with a utensil.

The invention has been shown and described above with reference to preferred embodiments, and it is understood that modifications, substitutions, and additions may be made which are within the intended spirit and scope of the invention. The invention is only to be limited by claims appended hereto.

What is claimed is:

1. A lid and utensil assembly, comprising:

a generally oval-shaped lid having a planar, continuous inner wall, a continuous side wall formed around and extending generally perpendicularly from the inner wall, a non-continuous seal rib on the interior of the side wall and extending around the periphery of the side wall forming one or more vents, and an attachment member extending downwardly from the inner wall and including a lip surrounding a distal end of the attachment member; and a one-piece rigid utensil having a cup-shaped portion with a continuously curved outer edge and a handle terminating in an end edge wherein the continuously curved outer edge of the cup-shaped portion is generally coplanar with the handle, the cup-shaped portion having a convex side, a plurality of strengthening ribs extending from the convex side of the cup-shaped portion substantially the length of the handle, and a single utensil attachment point comprising a single aperture through the handle located adjacent the terminal end edge of the handle away from the cup-shaped portion to aid in gripping, leveraging and removing the one-piece rigid utensil from the lid by pulling on the handle opposite the end edge;

wherein the attachment member of the lid is adapted to engage the single aperture generally such that the utensil is selectively secured to and removed from the lid, wherein the continuously curved outer edge of the cup-shaped portion is positioned adjacent to and facing the continuous inner wall when the one-piece rigid utensil is secured to the attachment member.

2. The assembly of claim 1 wherein the lid further comprises a plurality of side wall ribs spaced around the lid and extending at least partially from the inner wall to the side wall.

3. The assembly of claim 1 wherein the lid further comprises a lid skirt formed around and extending downwardly from the side wall.

4. The assembly of claim 3 wherein the non-continuous seal rib is formed inside the lid skirt around the periphery of the lid skirt.

5. The assembly of claim 1 wherein the lip is oval shaped.

6. The assembly of claim 1 wherein the convex side of the utensil includes a continuous rib around the handle.

7. The assembly of claim 1 wherein the cup-shaped portion of the utensil is wider than the handle.

8. The assembly of claim 1 wherein the aperture includes slots extending radially outward from the aperture to give flexibility to the aperture for attachment of the utensil to the lid.

9. A container, lid, and utensil assembly, comprising:

a generally oval-shaped container having a base, an integral sidewall extending upward from the base and forming a continuous sidewall around the base, an upper seal rim at an upper portion of the sidewall for engaging a lid, and a container skirt around an outside portion of the sidewall between the sidewall and the upper seal rim;

a generally oval-shaped lid having a planar, continuous inner wall, a continuous side wall formed around and extending generally perpendicularly from the inner wall, a non-continuous seal rib formed on the interior of the side wall around the periphery of the side wall forming one or more vents and adapted to engage the upper seal rim of the container, and an attachment member extending downwardly from the inner wall and including a lip surrounding a distal end of the attachment member;

a one-piece rigid utensil having a cup-shaped portion with a continuous outer edge and a handle with a terminal end wherein the continuous outer edge of the cup-shaped portion is generally coplanar with the handle, the cup-shaped portion having a convex side, a plurality of strengthening ribs extending from the convex side of the cup-shaped portion substantially the length of the handle, and an elongated aperture through the handle disposed adjacent the terminal end of the handle, wherein the elongated aperture has an elongated portion extending generally along a center line between and parallel to the plurality of strengthening ribs to aid in gripping, separating and removing the one-piece rigid utensil from the lid upon pulling on the handle generally opposite the terminal end;

wherein the aperture in the utensil is secured to the attachment member on the lid for securing the utensil with the continuous outer edge facing the continuous inner wall of the lid; and a tear-away membrane connected to the upper seal rim of the container to seal the inside of the container.

10. The assembly of claim 9 wherein the container skirt includes an arcuate-shaped cutout having a contour to match product packaging on the container.

11. The assembly of claim 10 wherein the product packaging includes graphics relating to contents of the container.

12. The assembly of claim 9 wherein the length of the utensil is greater than the height between the base and upper seal rim of the container.

13. The assembly of claim 9 further comprising a peel or tear-away membrane connected to the upper seal rim of the container to seal the inside of the container.

14. The assembly of claim 9 wherein the upper seal rim of the container includes a substantially planar top surface.

15. The assembly of claim 14 wherein the top surface of the upper seal rim is adapted to abut the lid such that air is able to pass through the vents in the lid during ambient pressure changes experienced during transport.

16. A container, lid, and utensil assembly, comprising:

a generally oval-shaped container having a base, an integral sidewall extending upward from the base and forming a continuous sidewall around the base, an upper seal rim at an upper portion of the sidewall for engaging a lid, and a continuous container skirt around an outside portion of the sidewall between the sidewall and the upper seal rim;

a generally oval-shaped lid having a planar, continuous inner wall, a continuous side wall formed around and extending generally perpendicularly from the inner wall, a non-continuous seal rib formed on the interior of the side wall around the periphery of the side wall forming one or more vents and adapted to engage the upper seal rim of the container;

a heat-sealed pouch attached within the container to the lid, the pouch comprising a first membrane with an outer peripheral edge continuously attached to and terminating at the upper seal rim, and a second membrane having an outer peripheral edge with one or more second membrane lift tabs, the outer peripheral edge of the second membrane connected to the first membrane to create a pocket between the first and second membranes, the heat-sealed pouch contained between the generally oval-shaped lid and the upper seal rim of the generally oval-shaped container, wherein the outer peripheral edge of the first membrane includes one or more first membrane lift tabs and wherein the second membrane lift tabs are spaced between the first membrane lift tabs for separating the second membrane from the first membrane and the first membrane from the upper seal rim or separating the first membrane from the upper seal rim and the second membrane from the first membrane;

a one-piece rigid utensil having a cup-shaped portion and a handle, the cup-shaped portion having a convex side, a plurality of strengthening ribs extending from the convex side of the cup-shaped portion substantially the length of the handle, the utensil positioned in the pocket between the first and second membranes of the heat-sealed pouch covered by the oval-shaped lid; and wherein the oval-shaped lid has an attached position to the upper seal rim of the oval-shaped container and a detached position, wherein the one or more lift tabs have a generally folded-down position when the oval-shaped lid is in the attached position.

17. The assembly of claim 16 wherein the container skirt includes an arcuate-shaped cutout with a contour to match product packaging on the container.

18. The assembly of claim 16 wherein the lid further comprises a plurality of generally vertical ribs spaced around the lid and extending at least partially from the inner wall to the side wall.

19. The assembly of claim 16 wherein the heat-sealed pouch is removably attached to the upper seal rim of the container.

20. The assembly of claim 16 wherein the heat-sealed pouch is removably attached to the side wall of the lid.

* * * * *